US006179521B1

(12) United States Patent
Muramatsu et al.

(10) Patent No.: US 6,179,521 B1
(45) Date of Patent: Jan. 30, 2001

(54) FLEXIBLE MEMBRANE MOUNTING METAL FITTING AND FLEXIBLE MEMBRANE INFLATING STRUCTURAL BODY

(75) Inventors: Tateo Muramatsu; Yoshihiro Sato; Shoji Naito, all of Yokohama; Satoshi Tagomori, Chigasaki, all of (JP)

(73) Assignee: Bridgestone Corporation, Tokyo (JP)

( * ) Notice: Under 35 U.S.C. 154(b), the term of this patent shall be extended for 0 days.

(21) Appl. No.: 09/357,661

(22) Filed: Jul. 20, 1999

(30) Foreign Application Priority Data

Aug. 4, 1998 (JP) ..... 10-220423

(51) Int. Cl.[7] ..... E02B 7/02
(52) U.S. Cl. ..... 405/115; 405/107; 405/91
(58) Field of Search ..... 405/90, 91, 107, 405/110, 115

(56) References Cited

U.S. PATENT DOCUMENTS

| | | | | |
|---|---|---|---|---|
| 3,355,851 | * | 12/1967 | Imbertson et al. | 405/115 |
| 4,279,540 | * | 7/1981 | Suga et al. | 405/115 |
| 4,299,514 | * | 11/1981 | Muramatsu et al. | 405/115 |
| 4,313,774 | * | 2/1982 | Tsuji et al. | 405/115 |
| 4,662,783 | * | 5/1987 | Muramatsu et al. | 405/115 |
| 4,836,713 | * | 6/1989 | Muramatsu et al. | 405/115 |
| 4,909,666 | * | 3/1990 | Takasaki | 405/115 |
| 5,067,851 | * | 11/1991 | Fujisawa et al. | 405/115 |
| 5,230,585 | * | 7/1993 | Fujisawa et al. | 405/115 |
| 5,388,928 | * | 2/1995 | Kumagai | 405/115 |
| 5,713,699 | * | 2/1998 | Obermeyer et al. | 405/115 |

FOREIGN PATENT DOCUMENTS

| | | | | |
|---|---|---|---|---|
| 1604293 | * | 12/1981 | (GB) | 405/115 |
| 0021610 | * | 2/1982 | (JP) | 405/115 |
| 0055311 | * | 3/1987 | (JP) | 405/115 |
| 0078307 | * | 4/1987 | (JP) | 405/115 |
| 404030012 | * | 2/1992 | (JP) | 405/115 |

* cited by examiner

*Primary Examiner*—Eileen D. Lillis
*Assistant Examiner*—Alexandra K. Pechhold
(74) *Attorney, Agent, or Firm*—Oliff & Berridge, PLC

(57) ABSTRACT

A flexible membrane inflating structural body is fixed to a structure such as a bed and slope sides of a waterway by using a mounting metal fitting comprising a first metal fitting and a second metal fitting. The flexible membrane inflating structural body is erected by supplying a fluid to an interior of a flexible membrane, and is deflated by discharging the fluid within the flexible membrane. The first metal fitting is disposed at a side of the structure at which the flexible membrane inflating structural body is provided and contacts one surface of the flexible membrane. The second metal fitting contacts another surface of the flexible membrane and, together with the first metal fitting, sandwiches a portion of the flexible membrane in a vicinity of an outer peripheral edge of the flexible membrane. The first and second metal fittings, which form the mounting metal fitting, each include at least one convex portion which bends the flexible membrane while the flexible membrane is in a held state. Corner portions of each convex portion of the mounting metal fitting are each chamfered so as to form a radius of curvature, and respective radii of curvature of the chamfered corner portions are set so as to be gradually made smaller toward the outer peripheral edge of the flexible membrane.

20 Claims, 16 Drawing Sheets

PRIOR ART

FLEXIBLE MEMBRANE MOUNTING METAL FITTING AND FLEXIBLE MEMBRANE INFLATING STRUCTURAL BODY

BACKGROUND OF THE INVENTION

1. Field of the Invention

The present invention relates to a flexible membrane inflating structural body such as a flexible membrane dam, which is provided on a bed of a waterway and is used as a dam (or a weir or a barrage), a wave absorbing dike, or the like, and further relates to a mounting metal fitting used in the flexible membrane inflating structural body to mount a flexible membrane onto a structure.

2. Description of the Related Art

For example, a flexible membrane dam used for a river is constructed in such a manner that a portion of a flexible membrane in the vicinity of an outer peripheral edge thereof, which flexible membrane is formed as an elongated planar sheet by vulcanization and integrally with an elastic body such as rubber, is mounted onto a structure (for example, a river bed and the side slopes thereof) by using a mounting metal fitting. This flexible membrane dam functions in a state in which it is expanded into a three-dimensional configuration by air being supplied to an interior of the flexible membrane.

A conventional mounting metal fitting used for a flexible membrane weir will be hereinafter described with reference to FIGS. 15 to 18.

A conventional mounting metal fitting 100 shown in FIG. 15 is comprised of a lower pressing metal fitting 104 provided in a lower structure 102 such as concrete, and an upper pressing metal fitting 110 which, together with the lower pressing metal fitting 104, sandwiches flexible membranes 106 and 108. Portions of the flexible membranes 106 and 108 in the vicinities of the outer peripheral edges thereof are fixed between the lower pressing metal fitting 104 and the upper pressing metal fitting 110 by fastening a nut 114 which is screwed on an anchor bolt 112 provided at the lower structure 102.

Convex portions 116 are formed in the lower pressing metal fitting 104 at both sides of the anchor bolt 112 in the transverse direction of the lower pressing metal fitting 104. Convex portions 118 are formed in the upper pressing metal fitting 110 at both sides of the anchor bolt 112 in the transverse direction of the upper pressing metal fitting 110. A convex portion 119 is formed in the upper pressing metal fitting 110 at the center thereof in the transverse direction. The flexible membranes 106 and 108 are bent by the convex portions 116, the convex portions 118, and the convex portion 119.

A conventional mounting metal fitting 120 shown in FIG. 16 includes a lower pressing metal fitting 122 and an upper pressing metal fitting 124. By screwing a bolt 128 into an anchor 126 embedded in the lower structure 102, portions of the flexible membranes 106 and 108 in the vicinities of the outer peripheral edges thereof are fixed between the lower pressing metal fitting 122 and the upper pressing metal fitting 124.

A convex portion 130 formed by a round bar is fixed to the lower pressing metal fitting 122 at a position further toward the main body of the flexible membrane weir than the bolt 128 (i.e., at the side of the bolt 128 in the direction opposite to the direction indicated by arrow E). A convex portion 132 is formed in the upper pressing metal fitting 124 at a position further toward the main body of the flexible membrane weir than the convex portion 130. The flexible membranes 106 and 108 are held in a state of being bent by the convex portion 130 and the convex portion 132.

In addition to the mounting metal fitting 100 and the mounting metal fitting 120, there is also a mounting metal fitting 140 shown in FIG. 17. The mounting metal fitting 140 includes a lower pressing metal fitting 142 and an upper pressing metal fitting 144. Portions of flexible membranes 106 and 108 in the vicinities of the outer peripheral edges thereof are fixed between the lower pressing metal fitting 142 and the upper pressing metal fitting 144 by fastening a nut 144 screwed on an anchor bolt 112 provided at the lower structure 102. As shown in FIG. 18A and FIG. 18B, a plurality of convex portions 146 are formed in the lower pressing metal fitting 142 at intervals, and a plurality of convex portions 148 are formed in the upper pressing metal fitting 144 at intervals. The flexible membranes 106 and 108 are held in a state of being bent by the plurality of convex portions 146 and the plurality of convex portions 148.

In all of the convex portions formed in the conventional mounting metal fitting 100 and in the conventional mounting metal fitting 120, the radius of curvature of the top portion thereof is set to be large. When two or more convex portions are provided in each mounting metal fitting, the respective tops of all of the convex portions are each set at the substantially same radius of curvature.

For this reason, if a tension f acting on the flexible membrane 108 due to expansion increases, the flexible membranes 106 and 108 cannot be supported by the mounting metal fitting. Accordingly, there is a problem in that even if the fastening force is increased, the entire flexible membranes 106 and 108 move slidingly.

SUMMARY OF THE INVENTION

The present invention has been devised as a result of examination in order to solve the above-described problem found in the conventional techniques, and an object thereof is to provide a mounting metal fitting which can reliably fix a flexible membrane on which a large tensile force acts, and further provide a flexible membrane inflating structural body in which a flexible membrane can reliably be held by the mounting metal fitting even if a large tensile force acts on the flexible membrane.

The present invention is a mounting metal fitting used for a flexible membrane inflating structural body which is erected by supplying a fluid to an interior of a flexible membrane and which is deflated by discharging the fluid within the flexible membrane, the mounting metal fitting including a first metal fitting disposed at a side of a structure at which the flexible membrane inflating structural body is provided and contacting one surface of the flexible membrane, and further including a second metal fitting contacting another surface of the flexible membrane, and together with the first metal fitting, sandwiching a portion of the flexible membrane in the vicinity of an outer peripheral edge thereof by a fixing means, wherein at least one convex portion is provided in each of the first and second metal fittings so as to bend the flexible membrane while the flexible membrane is being held, and corner portions of an end portion of the convex portion are chamfered so as to form a radius of curvature, and respective radii of curvature of the chamfered corner portions are set so as to be gradually made smaller toward the outer peripheral edge of the flexible membrane.

Operation of the mounting metal fitting according to the present invention will be described hereinafter.

When a fluid such as air, water and both water and air is supplied to an interior of the flexible membrane inflating structural body, the flexible membrane expands and a tension acts thereon. The tension acts, in the vicinity of the outer peripheral edge of the flexible membrane, in a direction which crosses the outer peripheral edge.

A portion of the flexible membrane held between the first and second metal fittings in the vicinity of the outer peripheral edge is bent by convex portions formed in the first and second metal fittings, and frictional force to the metal fittings is increased.

Here, cramping force which holds the flexible membrane using the first and second metal fittings is determined by equilibrium of the tension acting on the flexible membrane and the frictional force produced by the first and second metal fittings. At the side of a main body of the flexible membrane inflating structural body, the tension generated when the flexible membrane inflating structural body expands acts in such a direction as to open the first and second metal fittings, and when a coefficient of friction in the flexible membrane is low, the flexible membrane is drawn out to become thinner. Accordingly, the portion of the flexible membrane held by the first and second metal fittings, which is further disposed toward the main body of the flexible membrane inflating structural body (to the side where the tension acts) than the outer peripheral edge of the flexible membrane, is easy to move.

Further, in order to increase the coefficient of friction to the flexible membrane, the sharper the corner portion of the convex portion is, the better. However, there is a problem in that, when an amount by which the flexible membrane moves is large, the flexible membrane may be broken with a sharp-edged portion as a starting point.

The mounting metal fitting of the present invention is constructed in such a manner that respective chamfer dimensions (respective radii of curvature) of the corner portions of the convex portions are gradually made smaller to the outer peripheral edge of the flexible membrane. For this reason, even when a large tension acts on the flexible membrane, the flexible membrane held by the mounting metal fitting moves by a small amount at the side where the tension acts, but the movement of the flexible membrane at the side opposite thereto (that is, the side of the outer peripheral edge) can be completely prevented. Moreover, since respective chamfer dimensions of the corner portions of the convex portions are set so as to be gradually made smaller to the outer peripheral edge of the flexible membrane, which is not apt to move during application of the tension, there is no possibility of the flexible membrane being broken.

The present invention is a flexible membrane inflating structural body in which a portion of a flexible membrane in the vicinity of an outer peripheral edge thereof is mounted to a structure by a fixing means in a state in which the flexible membrane is held between a first metal fitting which contacts one surface of the flexible membrane and a second metal fitting which contacts another surface of the flexible membrane, the flexible membrane inflating structural body being erected by supplying a fluid to an interior of the flexible membrane and being laid flat by discharging the fluid within the flexible membrane, wherein at least one convex portion is provided in each of the first and second metal fittings so as to bend the flexible membrane while the flexible membrane is being held, and corner portions of an end portion of the convex portion are chamfered so as to form a radius of curvature, and respective radii of curvature of the chamfered corner portions are set so as to be gradually made smaller toward the outer peripheral edge of the flexible membrane.

Operation of the flexible membrane inflating structural body of the present invention will be described hereinafter.

The flexible membrane of the flexible membrane inflating structural body is mounted on the structure in such a manner that a portion thereof in the vicinity of the outer peripheral edge is held between the first and second metal fittings by the fixing means.

When a fluid such as air is supplied to an interior of the flexible membrane inflating structural body, the flexible membrane expands and a tension acts thereon. The tension acts, in the vicinity of the outer peripheral edge of the flexible membrane, in a direction which crosses the outer peripheral edge.

A portion of the flexible membrane held between the first and second metal fittings in the vicinity of the outer peripheral edge is bent by convex portions formed in the first and second metal fittings, and frictional force to the metal fittings is increased.

Here, cramping force which holds the flexible membrane using the first and second metal fittings is determined by equilibrium of the tension acting on the flexible membrane and the frictional force produced by the first and second metal fittings. At the side of a main body of the flexible membrane inflating structural body, the tension generated when the flexible membrane inflating structural body expands acts in such a direction as to open the first and second metal fittings, and when a coefficient of friction in the flexible membrane is low, the flexible membrane is drawn out to become thinner. Accordingly, the portion of the flexible membrane held by the first and second metal fittings, which is further disposed toward the main body of the flexible membrane inflating structural body (to the side where the tension acts) than the outer peripheral edge of the flexible membrane, is easy to move.

Further, in order to increase the coefficient of friction to the flexible membrane, the sharper the corner portion of the convex portion is, the better. However, there is a problem in that, when an amount by which the flexible membrane moves is large, the flexible membrane may be broken with a sharp-edged portion as a starting point.

The mounting metal fitting of the present invention is constructed in such a manner that respective chamfer dimensions (respective radii of curvature) of the corner portions of the convex portions are gradually made smaller to the outer peripheral edge of the flexible membrane. For this reason, even when a large tension acts on the flexible membrane, the flexible membrane held by the mounting metal fitting moves by a small amount at the side where the tension acts, but the movement of the flexible membrane at the side opposite thereto (that is, the side of the outer peripheral edge) can be completely prevented. Moreover, since respective chamfer dimensions of the corner portions of the convex portions are set so as to be gradually made smaller to the outer peripheral edge of the flexible membrane, which is not apt to move during application of the tension, there is no possibility of the flexible membrane being broken.

DESCRIPTION OF THE PREFERRED EMBODIMENTS

[First Embodiment]

An embodiment of the present invention will be described hereinafter with reference to the attached drawings.

Figure 1:
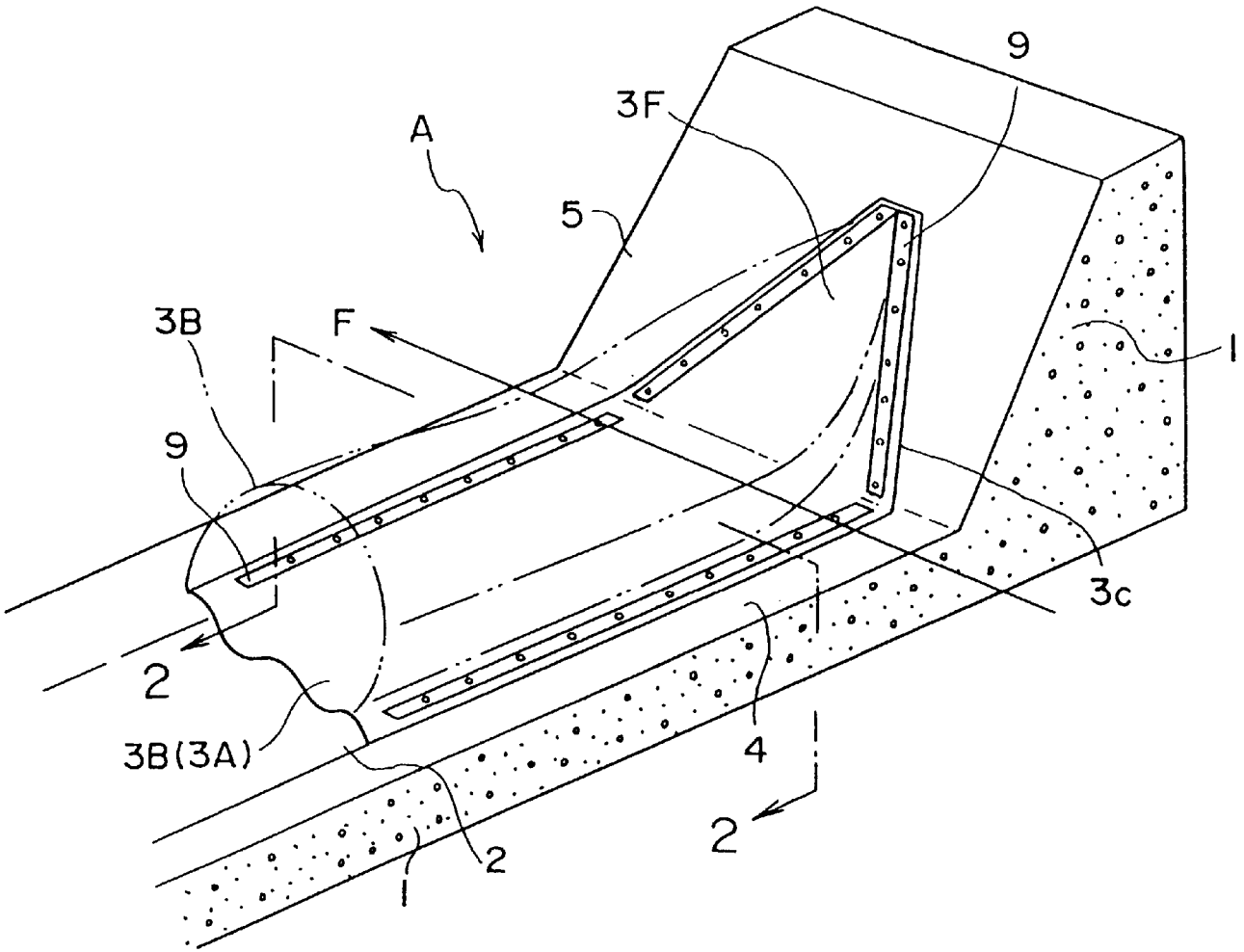
FIG. 1 is a perspective view which shows an outside of a flexible membrane dam according to an embodiment of the present invention.

FIG. 1 illustrates an embodiment of a flexible membrane dam A provided as a flexible membrane inflating structural body. In this figure, reference numerals 1 and 2 designate a mounting base, and a surface of the mounting base with a flexible membrane mounted thereon, respectively.

Figure 2:
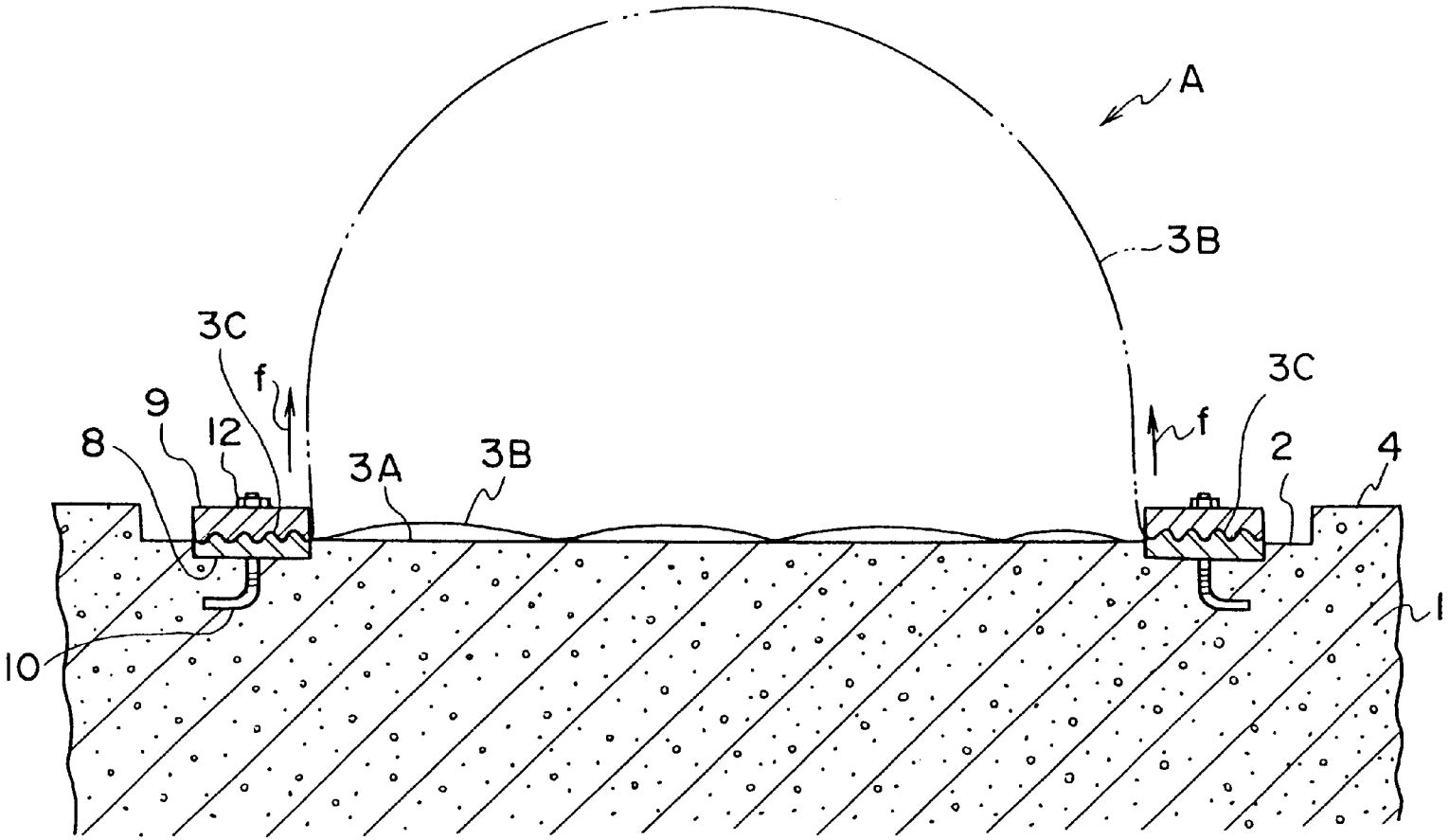
FIG. 2 is a cross-sectional view taken along the line 2—2 in FIG. 1.

FIG. 2 is a cross-sectional view of the flexible membrane dam A taken along the line 2—2 in FIG. 1.

The mounting surface 2 is comprised of a bed of waterway 4 for fixing most of flexible membranes 3A and 3B including a longitudinal-direction central portion thereof, which the flexible membranes are, for example, made of rubber coated textiles, and each upward side slope (side slope of a river dike) which is formed continuously from the bed of waterway 4 so as to fix respective end portions 3F of the flexible membranes 3A and 3B.

The flexible membrane 3A is disposed in a state of contacting closely the mounting surface 2 and the flexible membrane 3B forms an inflating air chamber between the flexible membranes 3A and 3B. Meanwhile, the flexible membrane 3A is provided so as to prevent leakage of air toward the mounting base 1 (and also prevent penetration of water into an interior of the air chamber. However, so long as airtightness and watertightness can be achieved, the flexible membrane 3A may not be provided.

As shown in FIG. 2, a lower pressing metal fitting 8 made of metal and forming one part of a mounting metal fitting, is provided in the base 1 and an anchor bolt 10 embedded in the base 1 passes through the lower pressing metal fitting 8.

Side end portions 3C of the flexible membranes 3A and 3B are disposed on an upper surface of the lower pressing metal fitting 8 in such a manner that the anchor bolt 10 passes therethrough.

By causing each anchor bolt 10 to pass through an upper pressing metal fitting 9 made of metal and forming another part of the mounting fitting and further by fastening a nut 12 engaged with the anchor bolt 10, the side end portions 3C of the flexible membranes 3A and 3B are mounted and fixed to the base 1 in a state of being held between the lower pressing metal fitting 8 and the upper pressing metal fitting 9.

Figure 3:
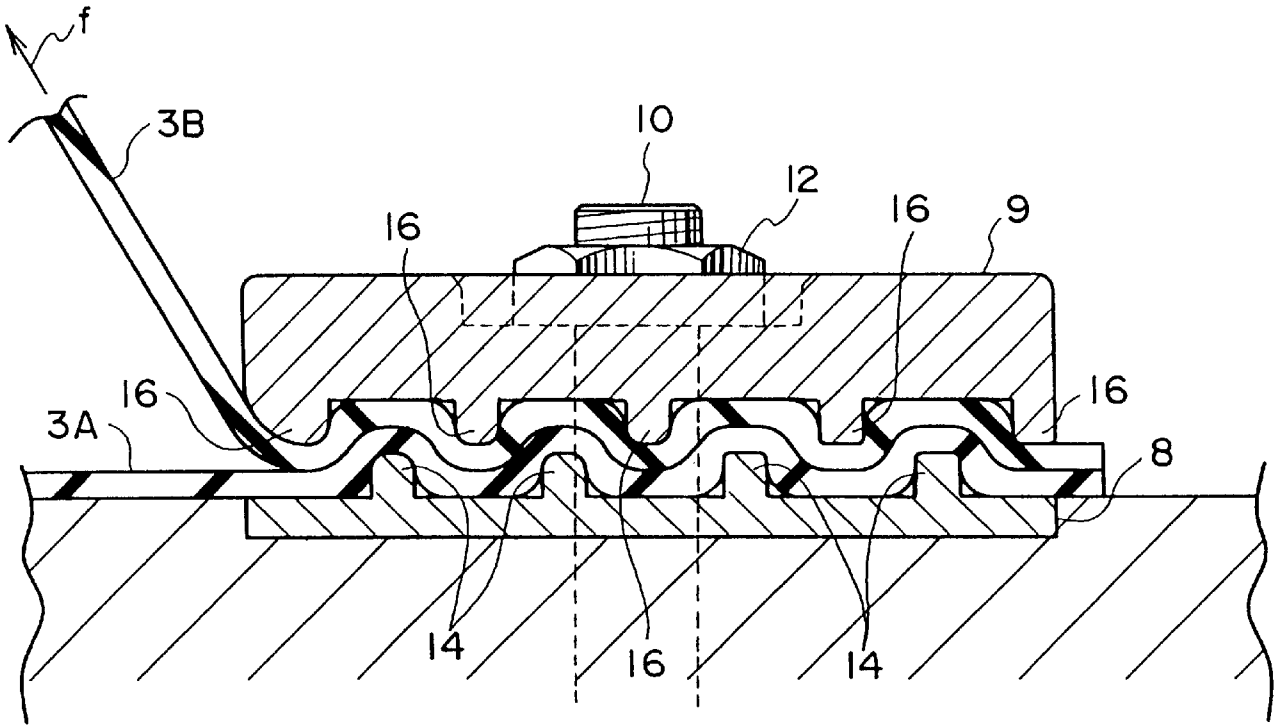
FIG. 3 is an enlarged cross-sectional view of an upper pressing metal fitting and a lower pressing metal fitting in a state of holding flexible membranes therebetween.

As shown in FIG. 3, four convex portions 14 each extending along the longitudinal direction of the metal fitting (i.e., the direction from the back to the front of the paper of FIG. 3) are formed in the lower pressing metal fitting 8 in the transverse direction of the lower pressing metal fitting 8 (in the direction indicated by arrow E and in a direction opposite thereto). Five convex portions 16 each extending along the longitudinal direction of the metal fitting are formed in the upper pressing metal fitting 9 at positions where they do not face the convex portions 14.

Figure 4A:
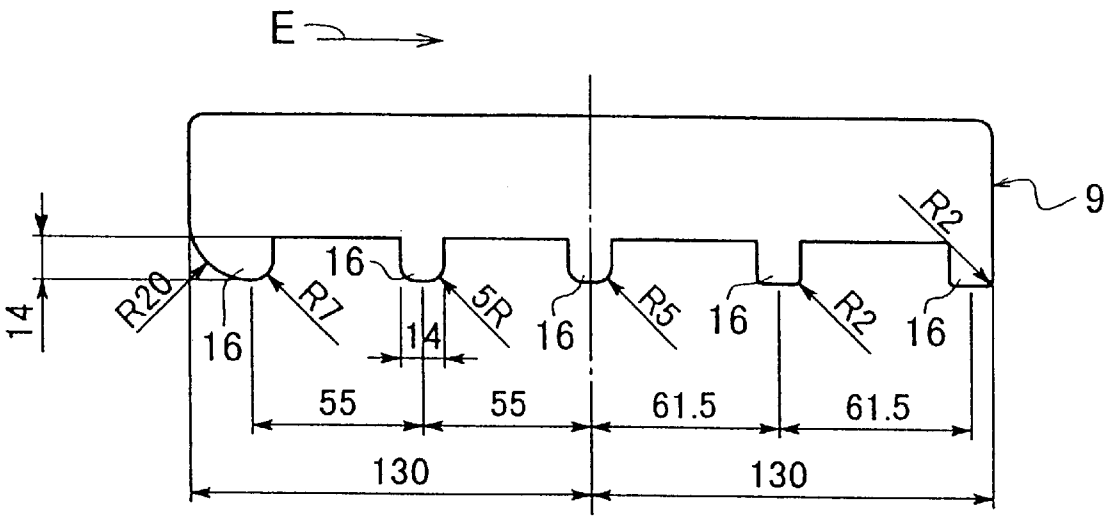
FIG. 4A is a dimensional diagram of the upper pressing metal fitting according to the embodiment of the present invention.
Figure 4B:
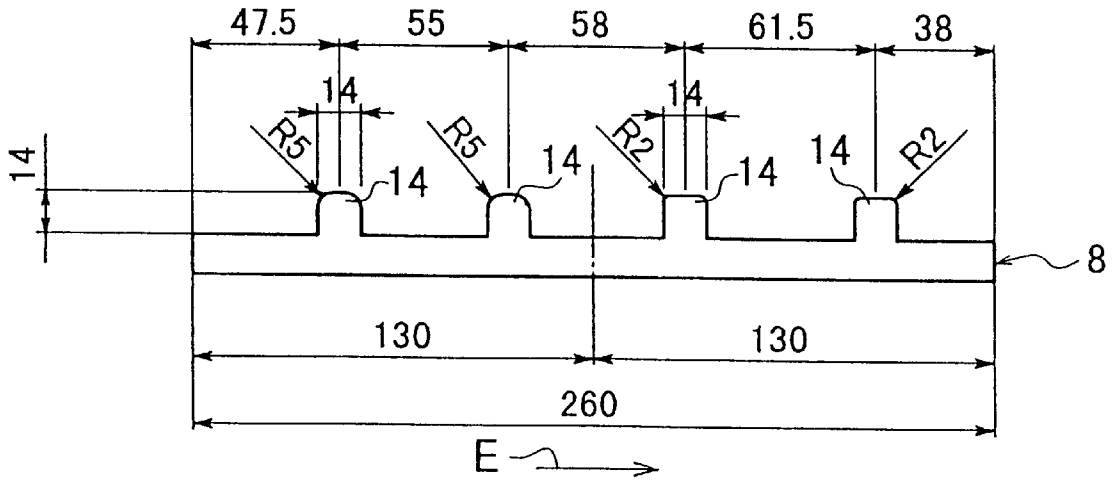
FIG. 4B is a dimensional diagram of the lower pressing metal fitting according to the embodiment of the present invention.

As shown in FIG. 4B (in this figure, numerical values other than reference numerals which designate structural elements each indicate a dimension (expressed in millimeters)), corner portions of each convex portion 14 of the lower pressing metal fitting 8 are each chamfered so as to form a radius of curvature. Respective radii of curvature of the corner portions are set at 5 mm and 2 mm so as to be gradually made smaller from the side opposite to the outer peripheral edges of the flexible membranes 3A and 3B (not shown in FIG. 4B) to the side of the direction indicated by arrow E.

As shown in FIG. 4A, corner portions of each convex portion 16 of the upper pressing metal fitting 9 is also chamfered so as to form a radius of curvature. Respective radii of curvature of the corner portions are set at 20 mm, 7 mm, 5 mm, and 2 mm so as to be gradually made smaller from the side opposite to the outer peripheral edges of the flexible membranes 3A and 3B (not shown in FIG. 4A) to the side of the direction indicated by arrow E.

Next, operation of the present invention will be described.

When air is supplied between the flexible membranes 3A and 3B, the flexible membrane 3B expands as indicated by the imaginary line in FIGS. 1 and 2, the flexible membrane weir A is erected.

When the flexible membrane weir A is erected, a tension f acts on the flexible membrane 3B as shown in FIGS. 2 and 3.

The lower pressing metal fitting 8 and the upper pressing metal fitting 9 are provided to bend the flexible membranes 3A and 3B by the convex portions 14 and the convex portions 16. Accordingly, respective frictional force of the lower pressing metal fitting 8 and the upper pressing metal fitting 9 with respect to the flexible membranes 3A and 3B is increased.

In the present embodiment, chamfer dimensions (radii of curvature) of corner portions in each of the convex portion 14 and the convex portion 16 are set so as to be gradually made smaller from the side opposite to the outer peripheral edges of the flexible membranes to the side of the direction indicated by arrow E. Accordingly, when the tension f acts, the flexible membranes 3A and 3B held by the lower pressing metal fitting 8 and the upper pressing metal fitting 9 move together by a small amount at the side where the tension acts (that is, at the side opposite to the direction indicated by arrow E), but the flexible membranes are completely prevented from moving at the side of the outer peripheral edges thereof.

Further, the chamfer dimensions of the corner portions in each of the convex portion 14 and the convex portion 16 are set so as to be gradually made smaller to the outer peripheral edges of the flexible membranes 3A and 3B which are not apt to move at the time of applying the tension thereto. Accordingly, breakage of the flexible membranes 3A and 3B can be prevented.

Moreover, since the chamfer dimensions of the corner portions in each of the convex portion 14 and the convex portion 16 are set so as to be gradually made smaller to the outer peripheral edges of the flexible membranes 3A and 3B, a counterclockwise moment around the anchor bolt 10 in FIG. 3 acts on the upper pressing metal fitting 9 during application of the tension, so as to prevent opening of the side of the upper pressing metal fitting 9 at the side where the tension acts (that is, the side of a main body of the flexible membrane dam A).

Figure 5:
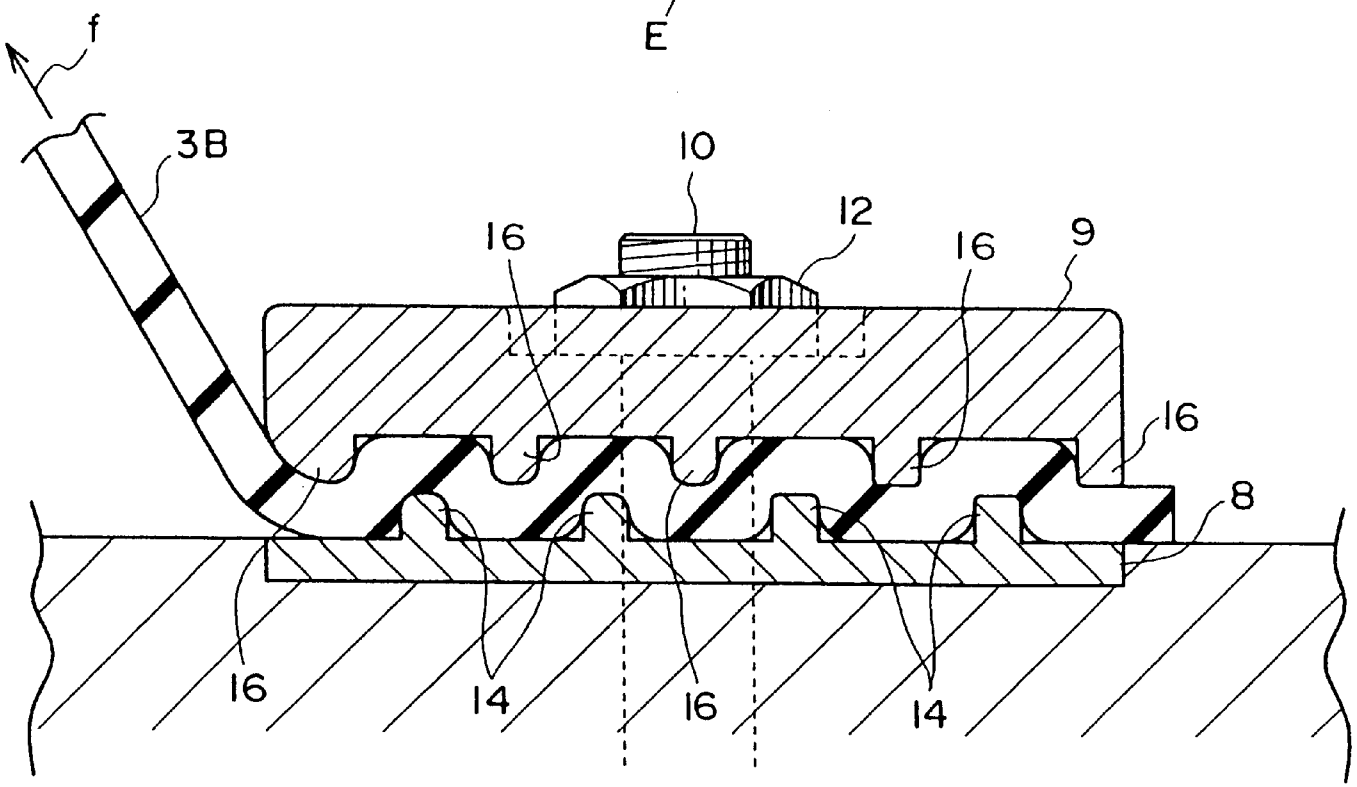
FIG. 5 is a cross-sectional view of a mounting metal fitting of the embodiment in a state of holding a flexible membrane at the time of making a test.
Figure 7:
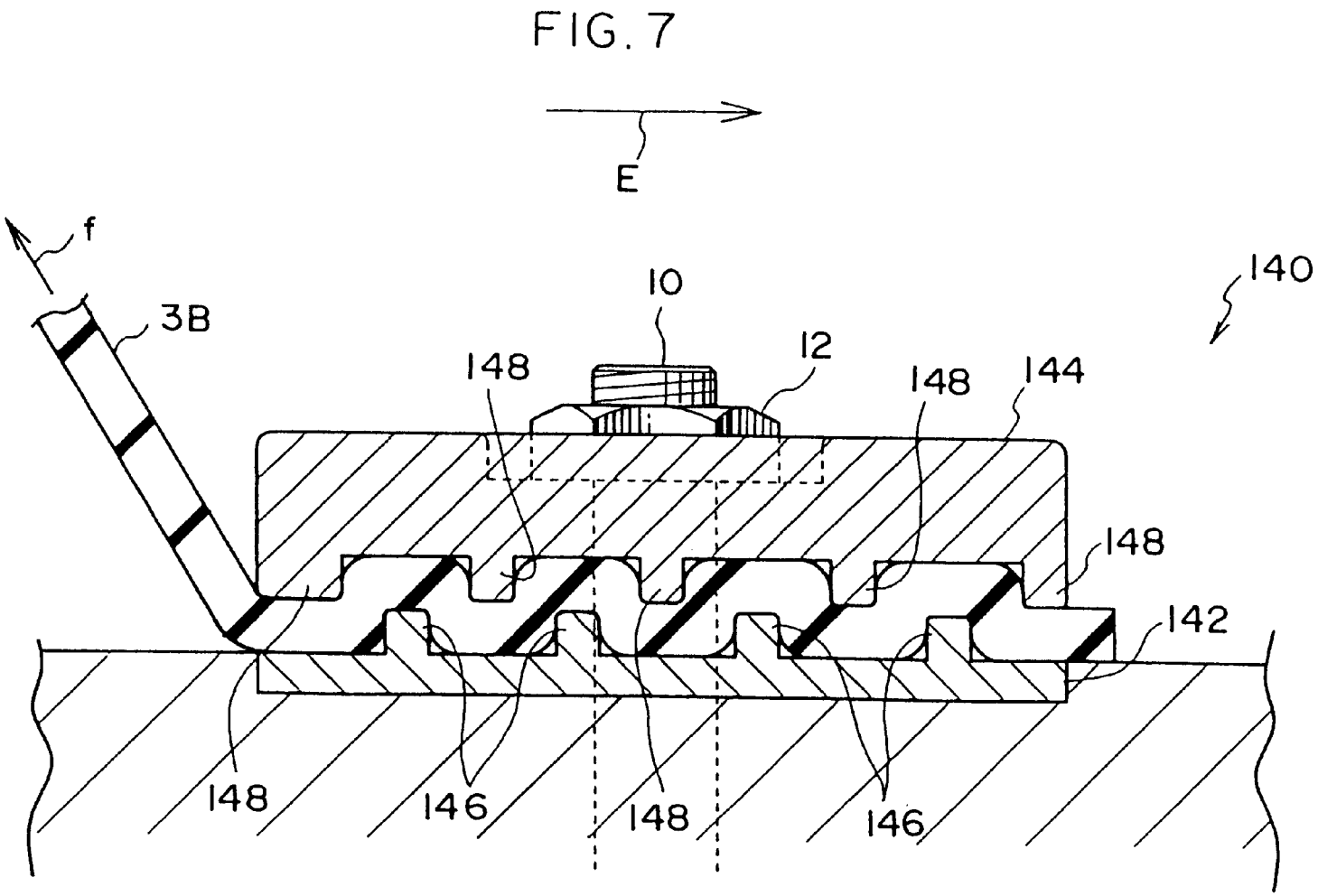
FIG. 7 is a cross-sectional view of a conventional mounting metal fitting in a state of holding a flexible membrane at the time of making a test.

Test Example:

In order to ascertain effects of the present invention, a conventional mounting metal fitting and a mounting metal fitting of an embodiment to which the present invention is applied were prepared, and inclinations of upper pressing metal fittings (9, 144) and an amount by which the flexible membrane 3B moves in each mounting metal fitting when the tension acts on one sheet of the flexible membrane 3B held by the mounting metal fittings shown in FIGS. 5 and 7 were examined.

Figure 18A:
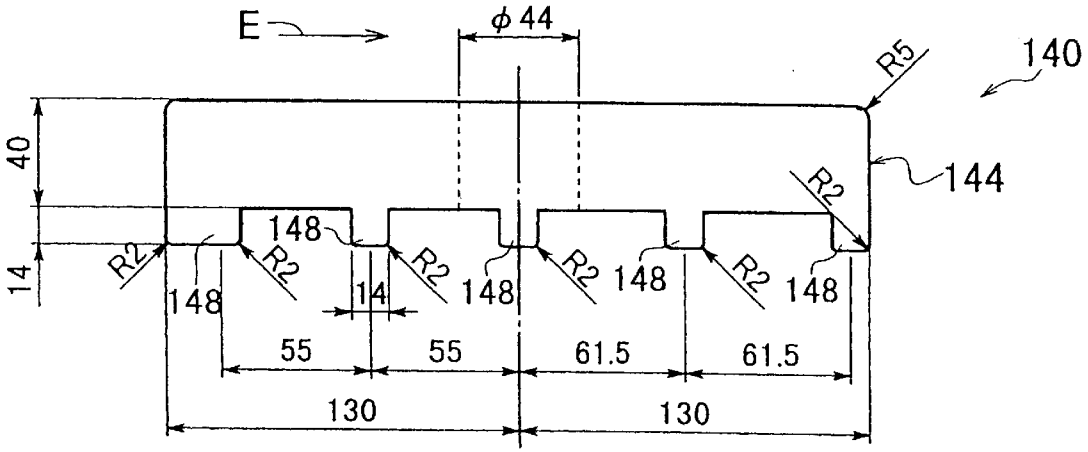
FIGS. 18A and 18B are dimensional diagrams of conventional upper pressing metal fitting and lower pressing metal fitting.
Figure 18B:
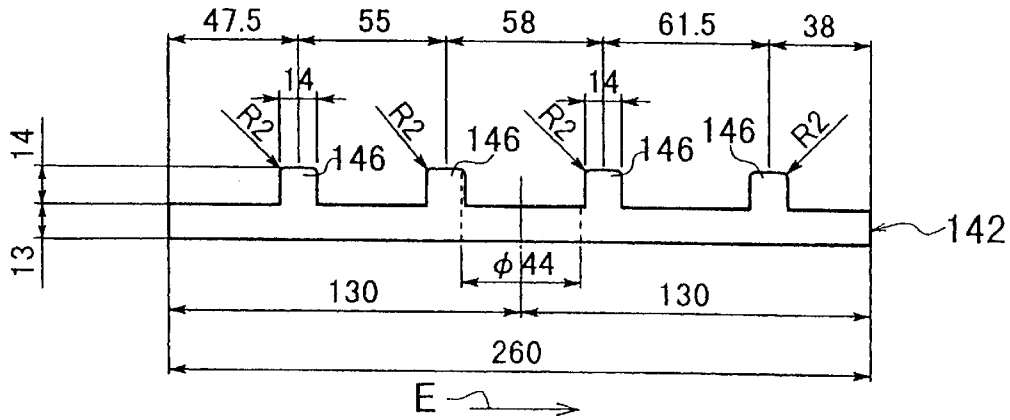

The dimensions of the mounting metal fitting according to the present embodiment are shown in FIGS. 4A and 4B, and the dimensions of the conventional mounting metal fitting are shown in FIGS. 18A and 18B.

Figure 6:
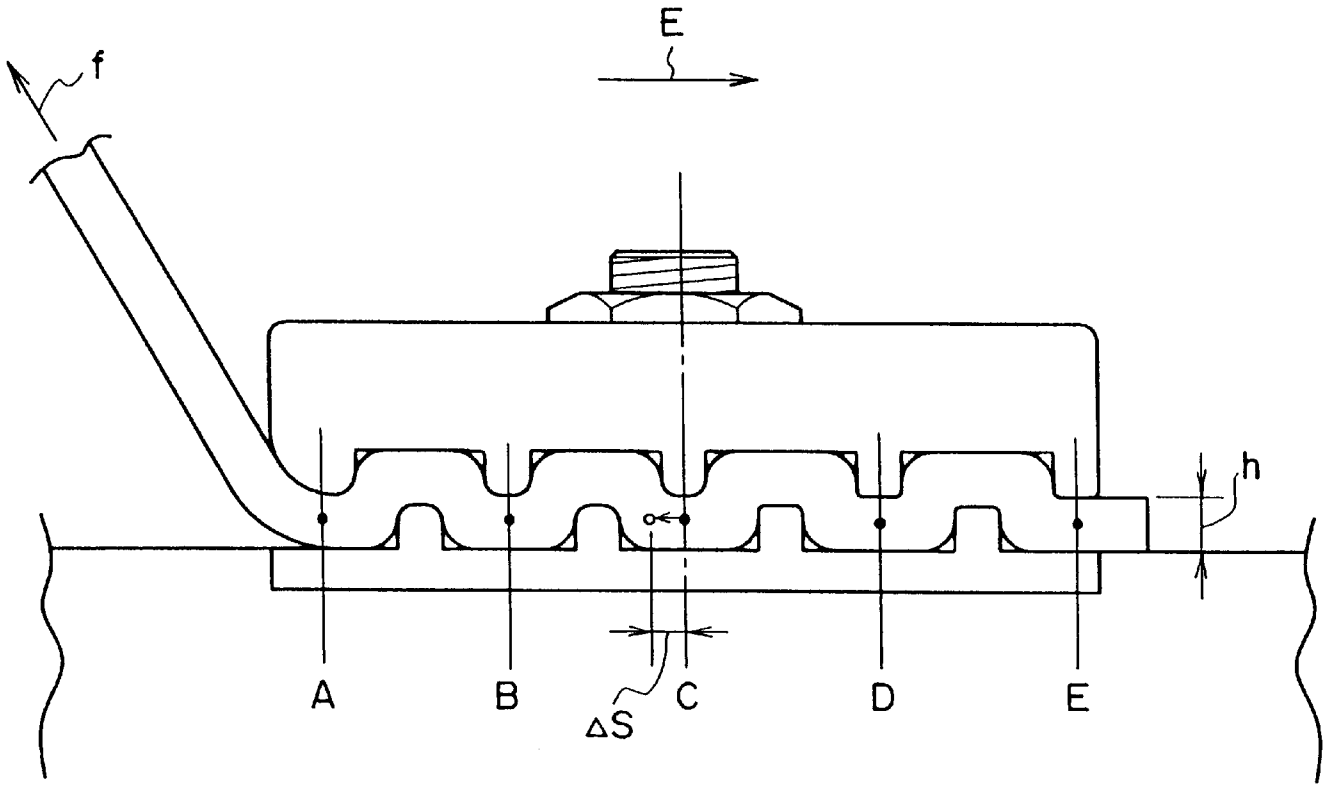
FIG. 6 is an explanatory diagram which shows measurement points for measuring an amount by which a flexible membrane held by the mounting metal fitting according to the embodiment of the present invention moves.

The inclination of the metal fitting is obtained by measuring a variation h (expressed in millimeters) of a distance between the lower pressing metal fitting and the upper pressing metal fitting at five locations A, B, C, D, and E shown in FIG. 6 when the tension f is increased in six stages in a predetermined stepwise manner (is increased from STEP 1 to STEP 6) and when the tension f is set at 0 after application of the maximum tension f (after TEST). FIG. 6 shows the measurement positions in the mounting metal fitting according to the present embodiment, but the measurement positions of the conventional mounting metal fitting are also the same ones as in the above case.

Figure 8:
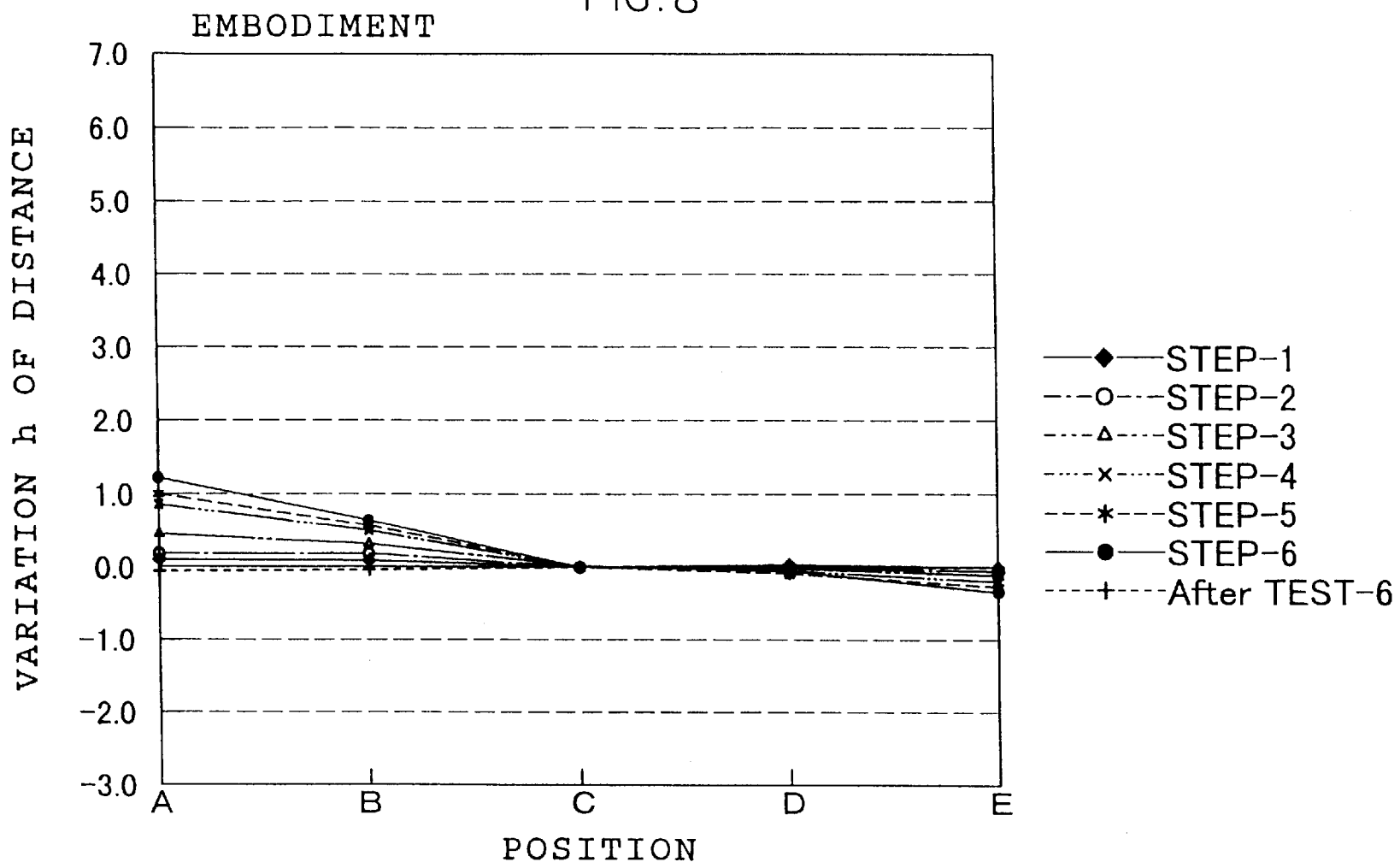
FIG. 8 is a graph which shows a variation in distance at each measurement point when a tension acting on the flexible membrane held by the mounting metal fitting of the present embodiment is changed.

The measurement result of the variation h of the distance in the mounting metal fitting according to the present embodiment is shown in the graph of FIG. 8. The horizontal axis of the graph indicates a position where the variation h of the distance is measured and the vertical axis indicates the variation h of the distance with the distance before application of tension being set as the reference. In the vertical axis, a plus-sign direction indicates that the distance becomes longer and a minus-sign direction indicates that the distance becomes narrow.

In order to obtain an amount by which the flexible membrane moves, ΔS, (see FIG. 6), positions corresponding to the above-described five points A, B, C, D, and E in the side end portion of the flexible membrane are marked and amounts of movement of these marks (from the positions prior to application of the tension) when the tension f is increased in six stages in a stepwise manner and an amount of movement when the tension f is set at 0 after application of the maximum tension f (from the position prior to application of the tension) are measured.

Figure 9:
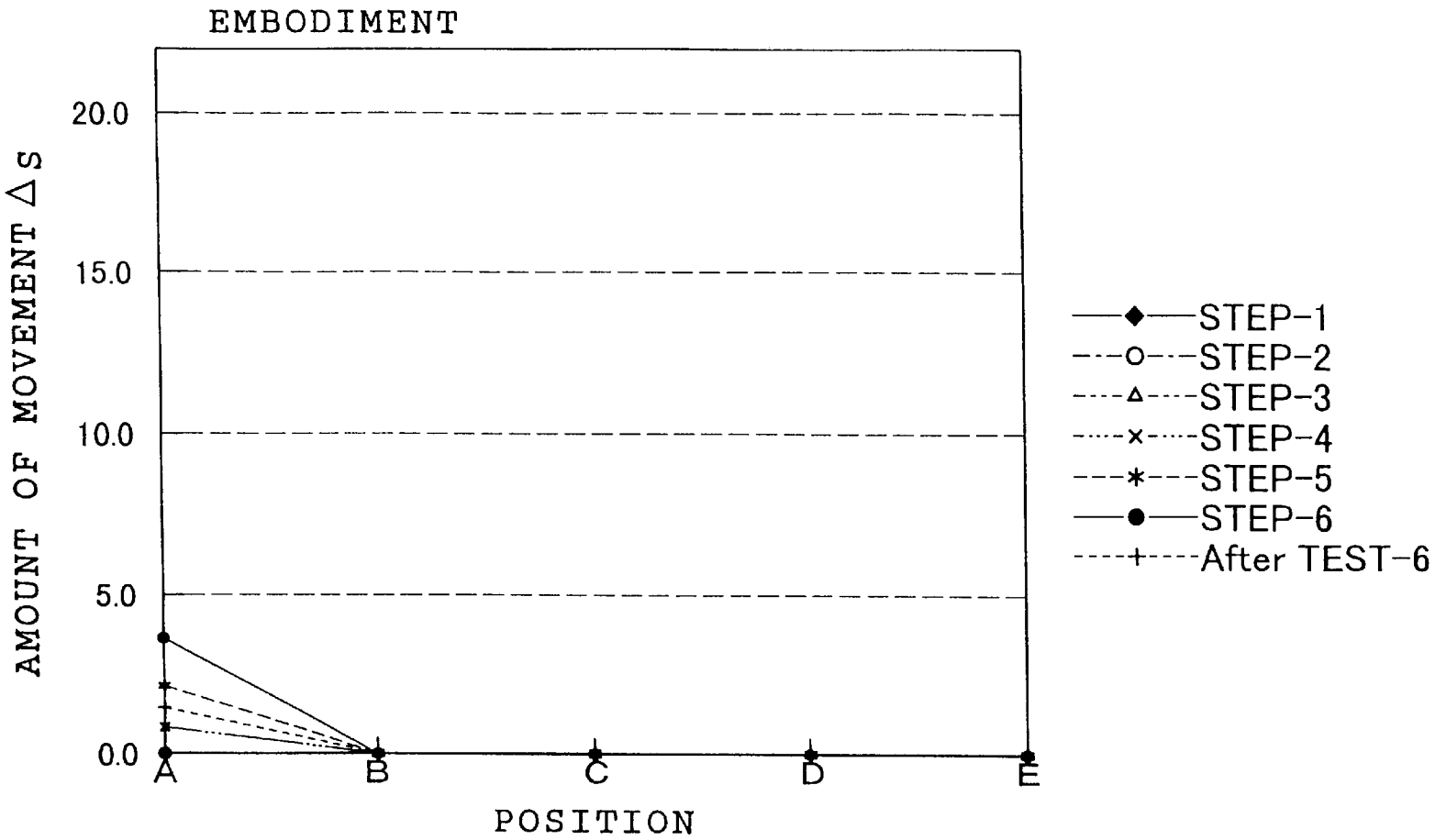
FIG. 9 is a graph which shows an amount of movement at each measurement point when the tension acting on the flexible membrane held by the mounting metal fitting of the present embodiment is changed.

The measurement result of the amount, ΔS, by which the flexible membrane held by the mounting metal fitting of the present embodiment moves is shown in the graph of FIG. 9. The vertical axis of the graph indicates the amount by which a mark moves, ΔS.

It can be seen from the measurement result that the flexible membrane fixed by the mounting metal fitting of the embodiment to which the present invention is applied is merely moved by a small amount at the side where the tension f acts and the mounting metal fitting of the present embodiment, which inclines a little at the time of application of the tension, shows an extremely excellent performance in holding the flexible membrane.

On the other hand, the flexible membrane fixed by the conventional mounting metal fitting move greatly at the side where the tension f acts as compared with a case of using the mounting metal fitting according to the present embodiment. Further, the inclination of the conventional mounting metal fitting at the time of application of the tension is also greater than that of the mounting metal fitting according to the present embodiment.

As a result of examination of the flexible membrane after the test, no damage was caused in the flexible membrane held by the mounting metal fitting of the present embodiment.

Further, as a result of repeatedly making a test in which the tension f is set at 0 after the tension f acts on the flexible membrane, the flexible membrane held by the conventional mounting metal fitting shows that a fracture portion of rubber in a portion of the flexible membrane held by the mounting metal fitting (nearer the side where the tension acts than the bolt) develops in tests of 5,000 times and the flexible membrane was cut off in tests of 30,000 times. On the other hand, no damage was caused in the flexible membrane held by the mounting metal fitting according to the present embodiment even after completion of tests of 50,000 times and it was proved that the flexible membrane held by the mounting metal fitting of the present embodiment is excellent in fatigue strength.

Next, another embodiments of the present embodiment will be described with reference to FIGS. 10 to 13.

Figure 10:
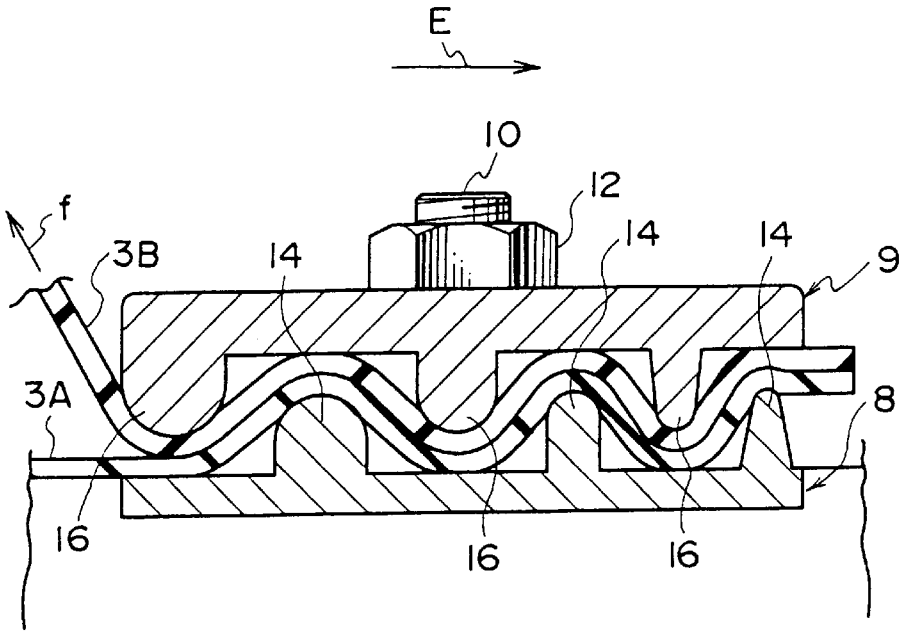
FIG. 10 is a cross-sectional view of a mounting metal fitting according to another embodiment.

Although in the lower pressing metal fitting 8 and the upper pressing metal fitting 9 which are shown in FIG. 3, respective widthwise dimensions of the convex portions 14 and the convex portions 16 are set fixedly, the present invention is not limited to the same. As shown in FIG. 10, respective widthwise dimensions of the convex portion 14 and the convex portion 16 may be gradually made smaller in accordance with the radius of curvature of the top of the convex portion.

Figure 11:
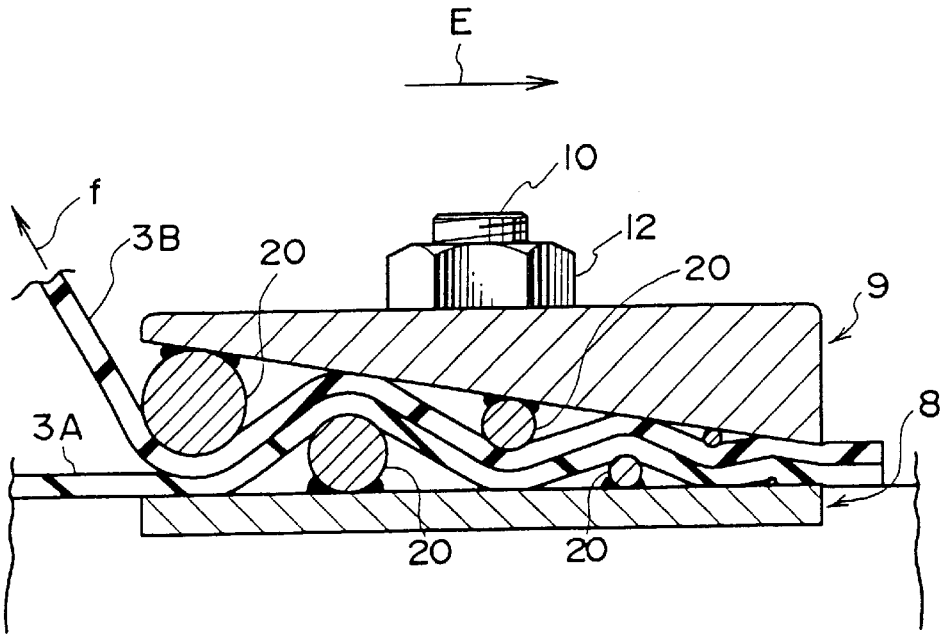
FIG. 11 is a cross-sectional view of a mounting metal fitting according to still another embodiment.

In an embodiment shown in FIG. 11, round bars 20 having different diametrical dimensions are fixed by welding or the like to the lower pressing metal fitting 8 and the upper pressing metal fitting 9. The diametrical dimension of a round bar 20 located at the side where the tension f acts is set to be large, and the diametrical dimension of a round bar 20 located at the side of the outer peripheral edge of a flexible membrane is set to be small.

In the lower pressing metal fitting 8 and the upper pressing metal fitting 9 shown in FIG. 11 as well, the radii of curvature of portions which press against the flexible membranes 3A and 3B are set so as to be gradually made smaller to the outer peripheral edges of the flexible membranes. Accordingly, when the tension f acts on the flexible membrane 3B, although the flexible membranes 3A and 3B held by the lower pressing metal fitting 8 and the upper pressing metal fitting 9 move by a small amount at the side where the tension acts, the movement of the flexible membranes 3A and 3B at the side of the outer peripheral edges thereof can be completely prevented, and further, damage (breakage) caused in the flexible membranes 3A and 3B can be prevented.

Figure 12:
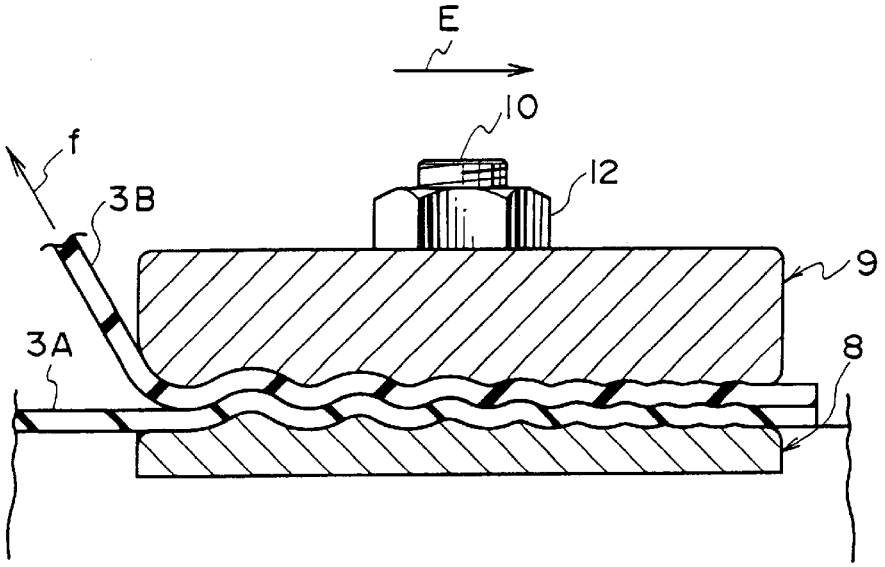
FIG. 12 is a cross-sectional view of a mounting metal fitting according to yet another embodiment.

In an embodiment shown in FIG. 12, each surface of the lower pressing metal fitting 8 and the upper pressing metal fitting 9 is formed in a corrugated manner so that the amplitude and wavelength of the wave form each become short to the outer peripheral edges of the flexible membranes. Respective radii of curvature of tops in the waveform are set so as to be gradually made smaller to the outer peripheral edges of the flexible membranes.

In the lower pressing metal fitting 8 and the upper pressing metal fitting 9 as well, the radii of curvature of portions which press against the flexible membranes 3A and 3B are set so as to be gradually made smaller to the outer peripheral edges of the flexible membranes. Accordingly, when the tension f acts on the flexible membrane 3B, although the flexible membranes 3A and 3B held by the lower pressing metal fitting 8 and the upper pressing metal fitting 9 move by a small amount at the side where the tension acts, the movement of the flexible membranes 3A and 3B at the side of the outer peripheral edges thereof can be completely prevented, and further, damage (breakage) caused in the flexible membranes 3A and 3B can be prevented.

Figure 13:
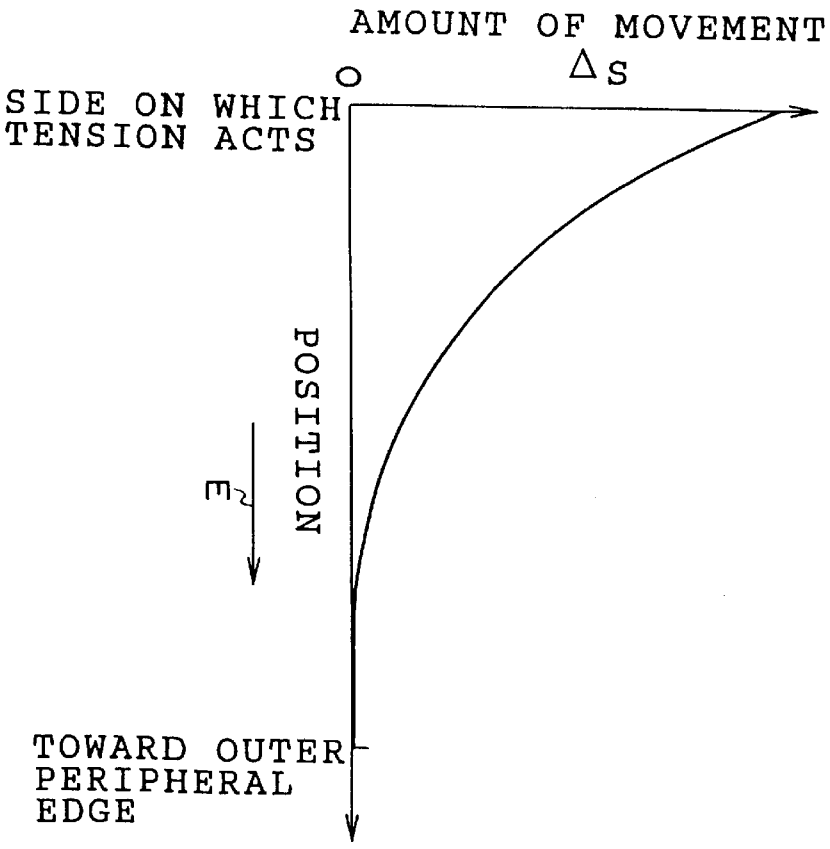
FIG. 13 is a graph which shows an amount by which a flexible membrane held by each mounting metal fitting of another embodiments moves when a tension acts on the flexible membrane.

In any of the mounting metal fittings shown in FIGS. 10 to 12 as well, as illustrated by the graph of FIG. 13, although the flexible membranes 3A and 3B are moved at the side where the tension acts, the movement of the flexible membranes at the side of the outer peripheral edges is completely prevented.

Further, in the present embodiment, as shown in FIG. 3, both end portions 3C of the flexible membranes 3A and 3B are fixed to the bed of waterway 4 by the lower pressing metal fitting 8 and the upper pressing metal fitting 9, and the flexible membrane weir A is erected by supplying air between the flexible membranes 3A and 3B. However, the present invention is not limited to the same. So long as excellent sealing properties are obtained, there may be used a structure in which both end portions 3C of the flexible membrane 3B are fixed to the bed of waterway 4 by the lower pressing metal fitting 8 and the upper pressing metal fitting 9, and the flexible membrane weir A is erected with air being supplied between the bed of waterway 4 and the flexible membrane 3B.

Figure 14:
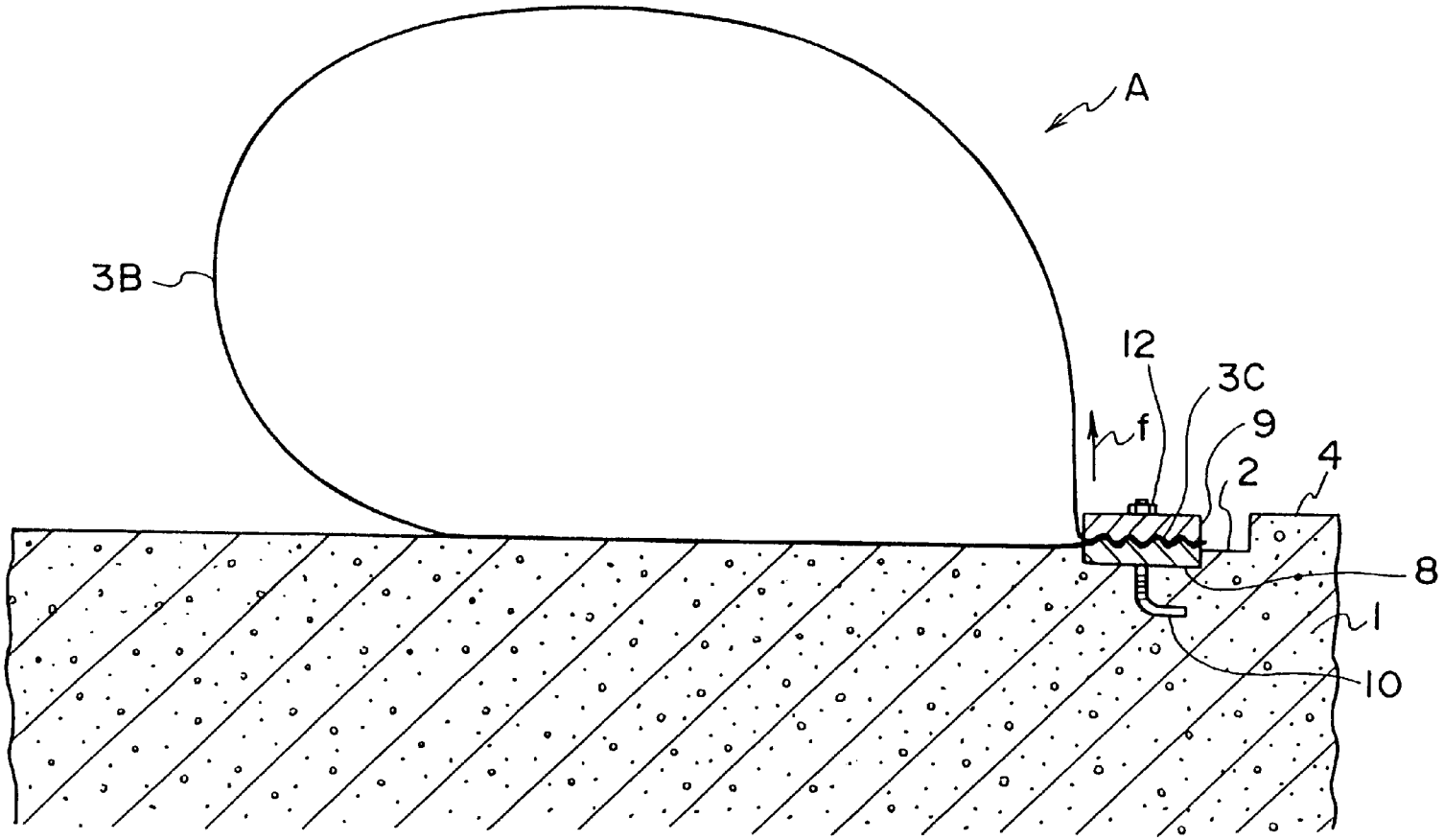
FIG. 14 is a cross-sectional view of a flexible membrane dam, which shows another method for fixing flexible membranes.
Figure 15:
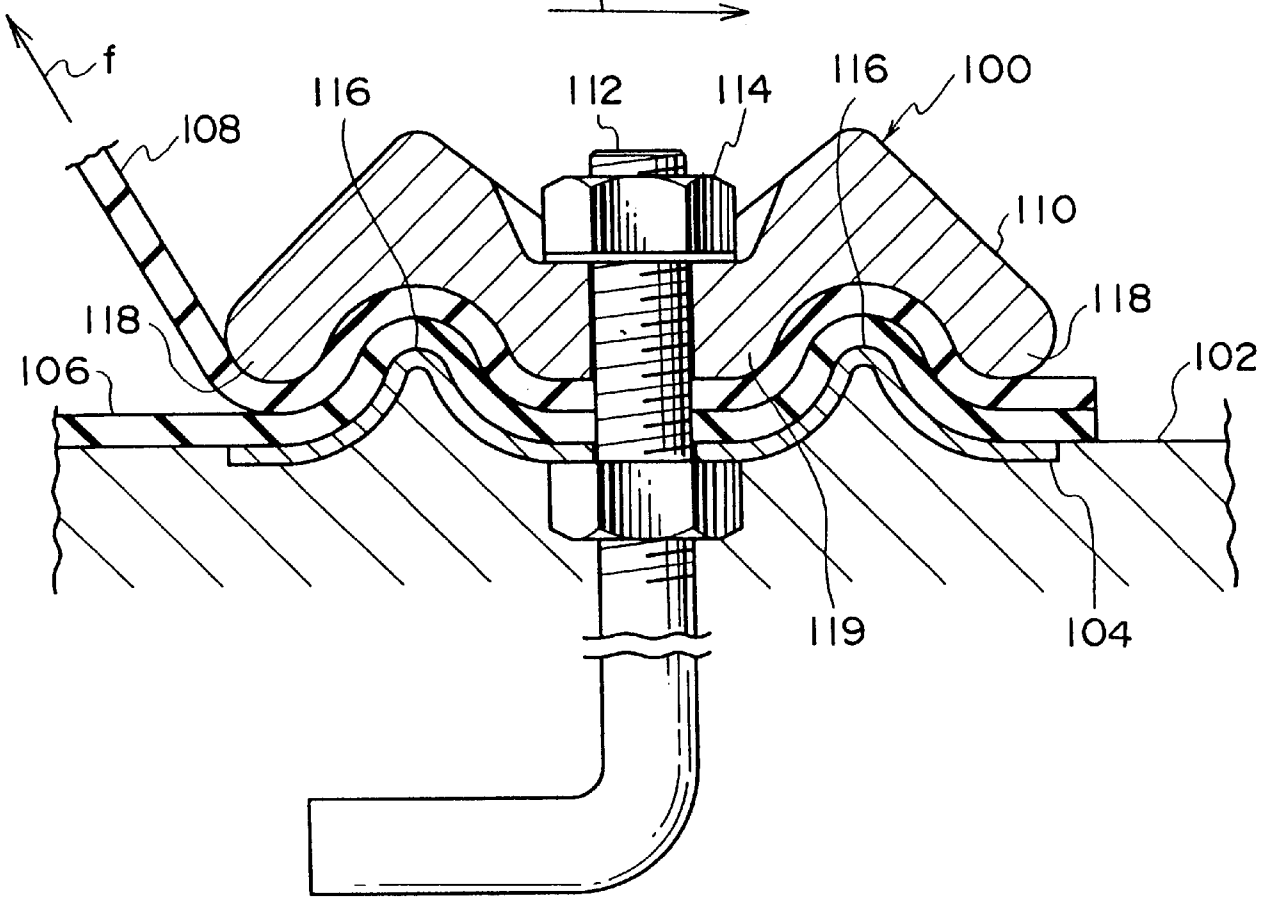
FIG. 15 PRIOR ART
FIG. 15 is a cross-sectional view of a conventional mounting metal fitting in a state of holding a flexible membrane.
Figure 16:
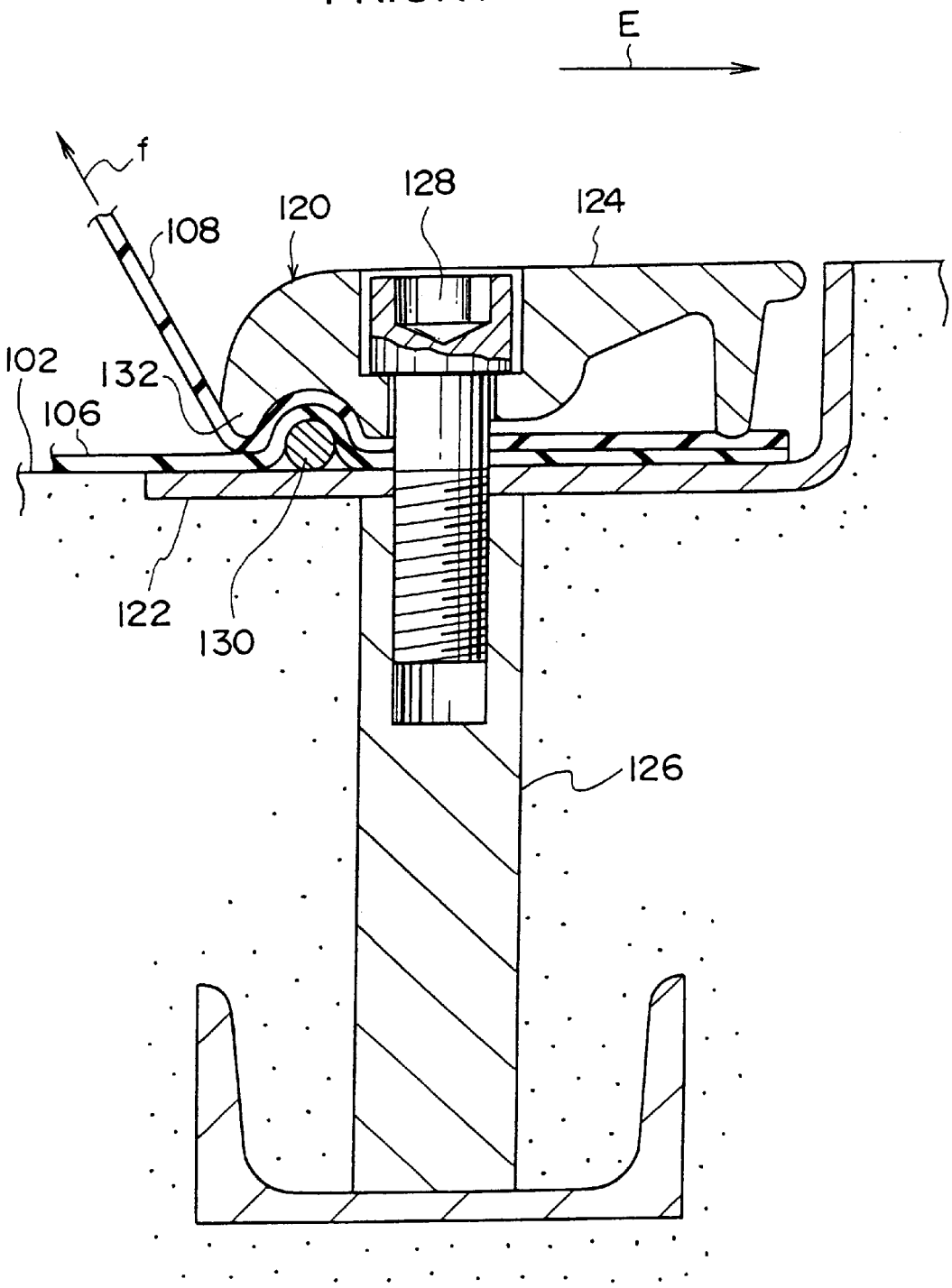
FIG.16 PRIOR ART
FIG. 16 is a cross-sectional view of another conventional mounting metal fitting in a state of holding a flexible membrane.
Figure 17:
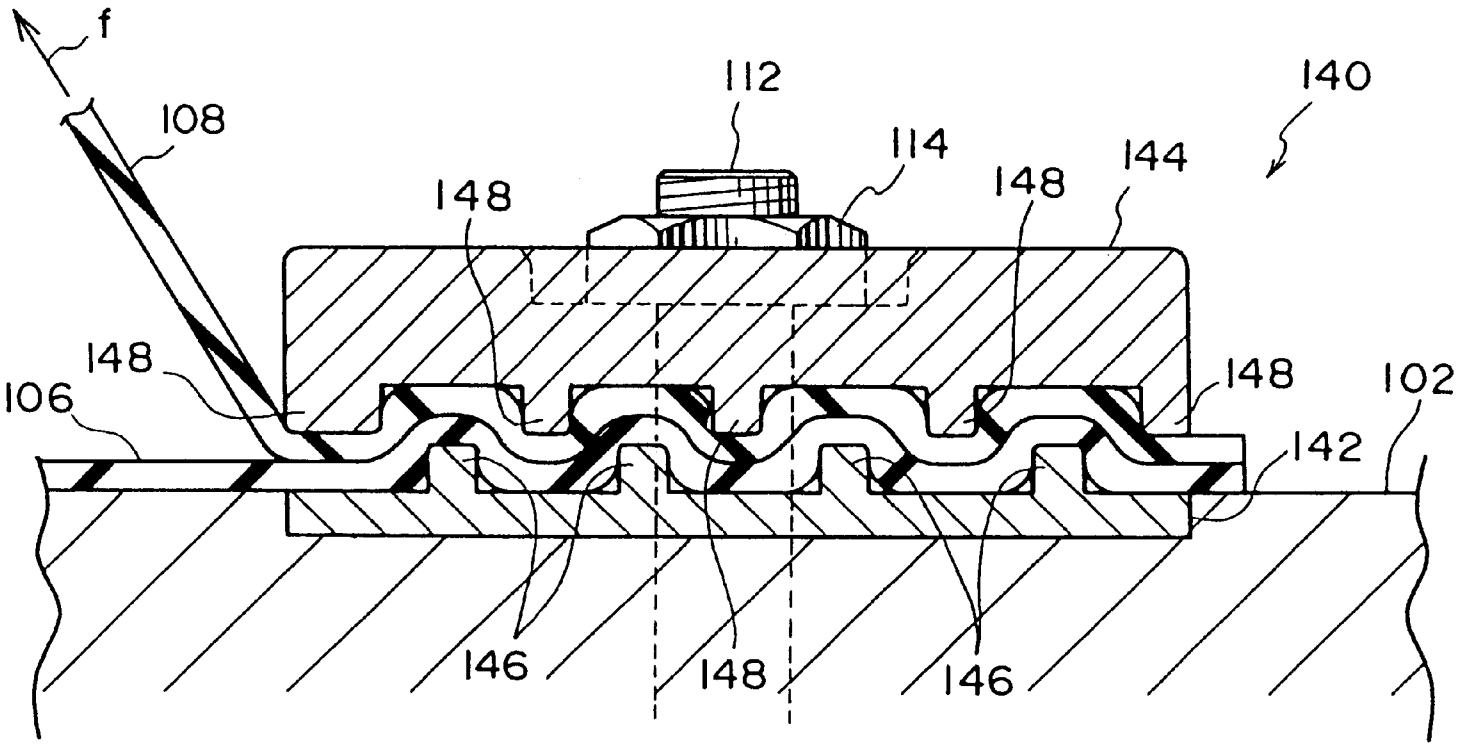
FIG. 17 PRIOR ART
FIG. 17 is a cross-sectional view of still another conventional mounting metal fitting in a state of holding a flexible membrane.

As shown in FIG. 2, both side end portions 3C of the flexible membranes 3A and 3B are fixed to the bed of waterway 4 by different lower pressing metal fittings 8 and upper pressing metal fittings 9, but the present invention is not limited to the same. For example, as shown in FIG. 14, both side end portions 3C of the flexible membrane 3B in a state of overlapping with each other are fixed to the bed of waterway 4 by one lower pressing metal fitting 8 and one upper pressing metal fitting 9.

A fluid, which is supplied to an interior of the flexible membrane inflating structured body, can be water or both water and air.

As described above, the mounting metal fitting of the present invention has the above-described structure, and therefore, it has an excellent effect in that a flexible membrane on which a large tension acts can be reliably fixed thereby without being damaged.

Further, the flexible membrane inflating structural body of the present invention has the above-described structure, and therefore, even if a large tensile force acts on a flexible membrane, the flexible membrane can reliably be fixed by mounting metal fitting.

What is claimed is:

1. A mounting metal fitting used for a flexible membrane inflating structural body which is erected by supplying a fluid to an interior of a flexible membrane and which is laid flat by discharging the fluid within the flexible membrane, said mounting metal fitting including a first metal fitting disposed at a side of a structure at which the flexible membrane inflating structural body is provided and contacting one surface of the flexible membrane, and further including a second metal fitting contacting another surface of the flexible membrane, and together with the first metal fitting, sandwiching a portion of the flexible membrane in the vicinity of an outer peripheral edge thereof by a fixing means, wherein at least one convex portion is provided in each of the first and second metal fittings so as to bend the flexible membrane while the flexible membrane is being held, and corner portions of an end portion of the convex portion are chamfered so as to form a radius of curvature, and respective radii of curvature of the chamfered corner portions are set so as to be gradually made smaller toward an outer end of the first and second meta fittings in the direction of the outer peripheral edge of the flexible membrane.

2. A mounting metal fitting according to claim 1, wherein the fixing means includes a bolt which passes through the first and second metal fittings holding the flexible membrane, and a nut which is screwed with the bolt, and the flexible membrane is mounted and fixed to a base by fastening the nut onto the bolt.

3. A mounting metal fitting according to claim 2, wherein the convex portion of the first metal fitting is embedded in the structure in such a manner as to project from a surface of the structure.

4. A mounting metal fitting according to claim 2, wherein the second metal fitting includes a concave portion in which at least one portion of the nut screwed with the bolt is embedded.

5. A mounting metal fitting according to claim 2, wherein at least one convex portions extending along a longitudinal direction of the second metal fitting are formed at the second metal fitting.

6. A mounting metal fitting according to claim 5, wherein the number of the convex portions extending along the longitudinal direction of the second metal fitting, which convex portions are formed at the second metal fitting at non-opposing positions to convex portions of the first metal fitting, is at least one of being the same as and being greater than the number of the convex portions of the first metal fitting by one.

7. A mounting metal fitting according to claim 1, wherein respective widthwise dimensions of convex portions of each of the first metal fitting and the second metal fitting are set so as to be gradually made smaller toward the outer peripheral edge of the flexible membrane.

8. A mounting metal fitting according to claim 1, wherein the convex portion of the first metal fitting is formed by a first group of a plurality of round bars which are fixed to a plate-like portion of the first metal fitting, and the convex portion of the second metal fitting is formed by a second group of a plurality of round bars which are fixed to a plate-like portion of the second metal fitting, respective diametrical dimensions of each of the first group of a plurality of round bars and the second group of a plurality of round bars being set so as to be gradually made smaller toward the outer peripheral edge of the flexible membrane.

9. A mounting metal fitting according to claim 1, wherein respective surfaces of the first and second metal fittings at the sides where the flexible membrane is held are each formed into a wave-shaped configuration in which respective radii of curvature of top portions of waves are gradually made smaller toward the outer peripheral edge of the flexible membrane.

10. A mounting metal fitting according to claim 1, wherein among the plurality of convex portions of the second metal fitting, at a convex portion located at the innermost side from an outer peripheral edge of the flexible membrane, a radius of curvature of a chamfered corner portion which faces an inner side of the flexible membrane is formed to be larger than a radius of curvature of a chamfered corner portion which faces an outer side of the flexible membrane.

11. A mounting metal fitting according to claim 1, wherein the fluid supplied to the interior of the flexible membrane to erect the flexible membrane inflating structural body is at least one of air, water or the mixture of air and water.

12. A flexible membrane inflating structural body in which a portion of a flexible membrane in the vicinity of an outer peripheral edge thereof is mounted to a structure by a fixing means in a state in which the flexible membrane is held between a first metal fitting which contacts one surface of the flexible membrane and a second metal fitting which contacts another surface of the flexible membrane, said flexible membrane inflating structural body being erected by supplying a fluid to an interior of the flexible membrane and being deflated by discharging the fluid within the flexible membrane, wherein at least one convex portion is provided in each of the first and second metal fittings so as to bend the flexible membrane while the flexible membrane is being held, and corner portions of an end portion of the convex portion are chamfered so as to form a radius of curvature, and respective radii of curvature of the chamfered corner portions are set so as to be gradually made smaller toward an outer end of the first and second metal fittings in the direction of the outer peripheral edge of the flexible membrane.

13. A flexible membrane inflating structural body according to claim 12, wherein the fixing means includes a bolt which passes through the first and second metal fittings holding the flexible membrane, and a nut which is screwed with the bolt, and the flexible membrane is mounted and fixed to a base by fastening the nut onto the bolt.

14. A flexible membrane inflating structural body according to claim 13, wherein at least one convex portions extending along a longitudinal direction of the second metal fitting are formed at the second metal fitting.

15. A flexible membrane inflating structural body according to claim 14, wherein the number of the convex portions extending along the longitudinal direction of the second metal fitting, which convex portions are formed at the second metal fitting at non-opposing positions to convex portions of the first metal fitting, is at least one of being the same as and being greater than the number of the convex portions of the first metal fitting by one.

16. A flexible membrane inflating structural body according to claim 13, wherein the second metal fitting includes a concave portion in which at least one portion of the nut screwed with the bolt is embedded.

17. A flexible membrane inflating structural body according to claim 12, wherein among the plurality of convex portions of the second metal fitting, at a convex portion located at the innermost side opposite to an outer peripheral edge of the flexible membrane, a radius of curvature of a chamfered corner portion which faces an inner side of the flexible membrane is formed to be larger than a radius of curvature of a chamfered corner portion which faces an outer side of the flexible membrane.

18. A flexible membrane inflating structural body according to claim 12, wherein the fluid supplied to the interior of the flexible membrane inflating structural body to erect the flexible membrane is at least one of air, water and the mixture of air and water.

19. A flexible membrane inflating structural body according to claim 12, wherein portions of the flexible membrane in vicinities of the longitudinal-direction outer edge sides thereof are each fixed to the structure by using a mounting metal fitting comprising the first and second metal fittings, which is provided at the structure in two rows.

20. A flexible membrane inflating structural body according to claim 12, wherein both longitudinal-direction end portions of the flexible membrane are fixed to the structure by using a mounting metal fitting comprising the first and second metal fittings, which is provided at the structure in one row.

* * * * *